US006280281B1

(12) United States Patent
Unalp

(10) Patent No.: US 6,280,281 B1
(45) Date of Patent: Aug. 28, 2001

(54) DOLL COMB HAVING APPARATUS FOR ATTACHING ORNAMENTS

(75) Inventor: Janet Unalp, Harrisville, MI (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/633,046

(22) Filed: Aug. 4, 2000

(51) Int. Cl.[7] ..... A63H 13/02

(52) U.S. Cl. ..... 446/75; 446/296; 446/394; 446/475

(58) Field of Search ..... 132/110, 111, 132/112, 113, 114, 115, 116, 125; 446/72, 73, 75, 296, 319, 394, 474, 475, 490

(56) References Cited

U.S. PATENT DOCUMENTS

| | | | |
|---|---|---|---|
| 2,426,444 | * | 8/1947 | Flageole . |
| 3,000,384 | | 9/1961 | Piers, Jr. . |
| 3,542,041 | | 11/1970 | Mercorella . |
| 4,690,279 | | 9/1987 | Hochberg . |
| 5,076,298 | | 12/1991 | Busch et al. . |
| 5,154,193 | | 10/1992 | Busch et al. . |
| 5,277,645 | * | 1/1994 | Kelley et al. . |
| 5,293,884 | | 3/1994 | Chapman et al. . |
| 5,344,356 | | 9/1994 | Pizzelli et al. . |
| 5,421,765 | | 6/1995 | Lehmann et al. . |
| 5,598,585 | | 2/1997 | Stroup . |
| 5,725,130 | | 3/1998 | Kluge et al. . |
| 5,727,575 | | 3/1998 | Rontal . |
| 5,799,672 | | 9/1998 | Hansbury . |

* cited by examiner

*Primary Examiner*—Jacob K. Ackun, Jr.
*Assistant Examiner*—Shaquita M. McConnell
(74) *Attorney, Agent, or Firm*—Roy A. Ekstrand

(57) ABSTRACT

A doll supports a quantity of hair which may be combed by a hand held comb. The hand held comb defines a comb head having one surface supporting an elongated ornament magazine. The ornament magazine defines a channel which receives a plurality of hair ornaments in a sliding support. The hair ornaments further include outwardly extending hook attachment pads of the type commonly used in hook and loop fasteners. The hook pads extend beyond the magazine and engage underlying hair as the comb is moved upon the hair surface. The engagement of the hook pads allows the ornaments to be drawn from the magazine and remain temporarily secured to the hair.

10 Claims, 2 Drawing Sheets

DOLL COMB HAVING APPARATUS FOR ATTACHING ORNAMENTS

FIELD OF THE INVENTION

This invention relates generally to dolls and particularly to hair play apparatus for use in combination therewith.

BACKGROUND OF THE INVENTION

Hair play dolls are well known in the art and derived their name from the focus of play activity upon styling the doll's hair. One of the more popular types of hair play dolls, known generally in the art as "fashion dolls", often relies heavily upon very exaggerated and extreme hair play. Such fashion dolls utilize a small relatively thin high fashion doll body which supports a disproportionately long hair style. For the most part, such fashion dolls are clothed in garments which are relatively sophisticated, colorful and of high fashion design. A substantial portion of fashion doll hair play is intended to generally mimic and often exaggerate human hair grooming and hair ornamentation activities. For the most part, human grooming activities often focus substantially on various hair fasteners or hair tie apparatus. For example, U.S. Pat. No. 3,000,384 issued to Piers, Jr. Sets forth a FASTENER TIE having an elongated straps supporting a plurality of hook and loop fastener attachment pads. The elongated strap is ornament ed and is intended to retain or clasp a substantial quantity of hair drawn rearwardly upon the wearer's head. Such hair styles have often been known in the art as "pony tails".

U.S. Pat. No. 3,542,041 issued to Marcella sets forth HAIR FASTENERS AND METHODS OF USING THE SAME designed to fasten together a body of hair at the head of the wearer. The fastener includes an elongated endless stretchable elastic filament supporting a pair of elongated portions and a pair of flexible tag connected to opposed portions of the filament. Fastening means are provided for securing the tabs to each other in overlapping relation.

U.S. Pat. No. 5,293,884 issued to Chap man et al sets forth a LOOP STRAP HAIR TIE used to fasten locks of hair into ponytails, braids or deadlocks. The hair tie includes a generally planar elongated material containing corresponding fastening surfaces at each end. Additionally the hair tie incorporates an elastic loop and friction pad to ensure that the hair tie securely attaches and remains in position on the lock of hair. Ornamentation such as jewelry, beads and ribbon may decorate the hair tie.

U.S. Pat. No. 5,598,585 issued to Soup sets forth a HEADBAND WITH PONYTAIL HOLDER includes an elongated member having an inner surface, an outer surface, a first generally U-shaped end having outwardly extending legs, and a second generally U-shaped end having corresponding outwardly extending legs. The headband further includes a pair of hook-and-loop type fasteners on each of the end pairs for overlapping attaching above and below the ponytail.

U.S. Pat. No. 5,727,575 issued to Rental sets forth a HAIR SECURING DEVICE having a fabric panel for wrapping about and enclosing a ponytail. A plurality of fastening bands having hook-and-loop attachment pads thereon are secured to the panel to complete its attachment about the ponytail.

U.S. Pat. No. 5,799,672 issued to Hans bury sets forth a HAIR RETAINING DEVICE formed of length of fabric or other sheet material and defining an elongated pocket suitable for receiving and supporting a conventional pipe cleaner. A gripping member is attached at the center portion of the fabric length for gripping the hair bundle. The malleable type cleaner is used to form the elongated strip about the ponytail hair.

Other types of hair grooming devices often utilize variations of combs which provide multiple functions in addition to hair combing. For example, U.S. Pat. No. 5,725,130 issued to Kludge et al sets forth a COMB AND DISPENSER UNIT for grooming hair or fur. The unit includes a reservoir having an outwardly flared base with a flat bottom surface for stable support. A handle portion is coupled to the reservoir and includes a pump actuator in communication with the reservoir and a nozzle. A comb is coupled to a handle portion with teeth extending away from the handle. The nozzle is coupled to a portion of the comb for spraying fluid pumped from the reservoir into the hair.

U.S. Pat. No. 5,154,193 issued to Bunch et al sets forth a CONTINUOUS HAIR DYE DISPENSING DEVICE for continuous application of hair dye to a person's hair. A porous material is supported within a housing together with teeth made of the porous material such that capillary action transfers the dye to the porous material to the teeth. A reservoir supplies the fluid to the porous material for transfer by capillary action to the teeth. As the unit is combed through the hair, the dye is transferred from the teeth to the hair.

U.S. Pat. No. 5,076,298 issued to Bunch et al sets forth a DISPENSER FOR MULTI COMPONENT HAIR COSMETIC PRODUCTS having a tubular element including absorbent material in separate storage compartments therein. Each product is then supplied to the separate storage compartments. The device further includes a plurality of fines of absorbent material partially inserted into each of the storage compartments for transferring the fluid onto hair in a combing action.

U.S. Pat. No. 4,690,279 issued to Hochberg sets forth a BIRTH CONTROL DISPENSER IN THE FORM OF A HAIR BRUSH having a hair brush defining an interior cavity within which a quantity of pills are stored.

U.S. Pat. No. 5,421,765 issued to Lehmann et al sets forth a TOY TATTOO PLAYSET while U.S. Pat. No. 5,344,356 issued to Pizzelli et al sets forth a DECORATIVE TOY AND STORAGE UNIT WITH ATTACHABLE HOLDERS both of which represent illustrative examples of toy devices which utilize a transfer and attachment of a decorative or ornamental item to a doll or human participant.

While the foregoing described prior art devices have often improved the art and in some instances enjoyed commercial success, there remains nonetheless a continuing need in the art for ever more interesting, amusing and entertaining hair play dolls and apparatus.

SUMMARY OF THE INVENTION

Accordingly, it is a general object of the present invention to provide an improved hair play apparatus for use with a doll. It is more particular object of the present invention to provide an improved hair play apparatus for use with a doll which is capable of transferring ornamental objects to a dolls hair.

In accordance with the present invention there is provided a hairplay doll and doll comb comprising: a doll having a quantity of doll hair; a comb having a handle and a comb head defining a plurality of comb teeth; an ornament magazine supported on the comb head defining an open ornament channel; and a plurality of hair ornaments each having an ornament body slidably receivable in the ornament channel and each having a hook attachment pad, the ornament magazine and the hair ornaments constructed to allow a portion of the hook attachment pads to extend beyond the magazine whereby the hook attachment pads are able to engage the doll hair when stroked against the doll hair to draw the hair ornaments from the ornament magazine.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figures 1, 2, 5:
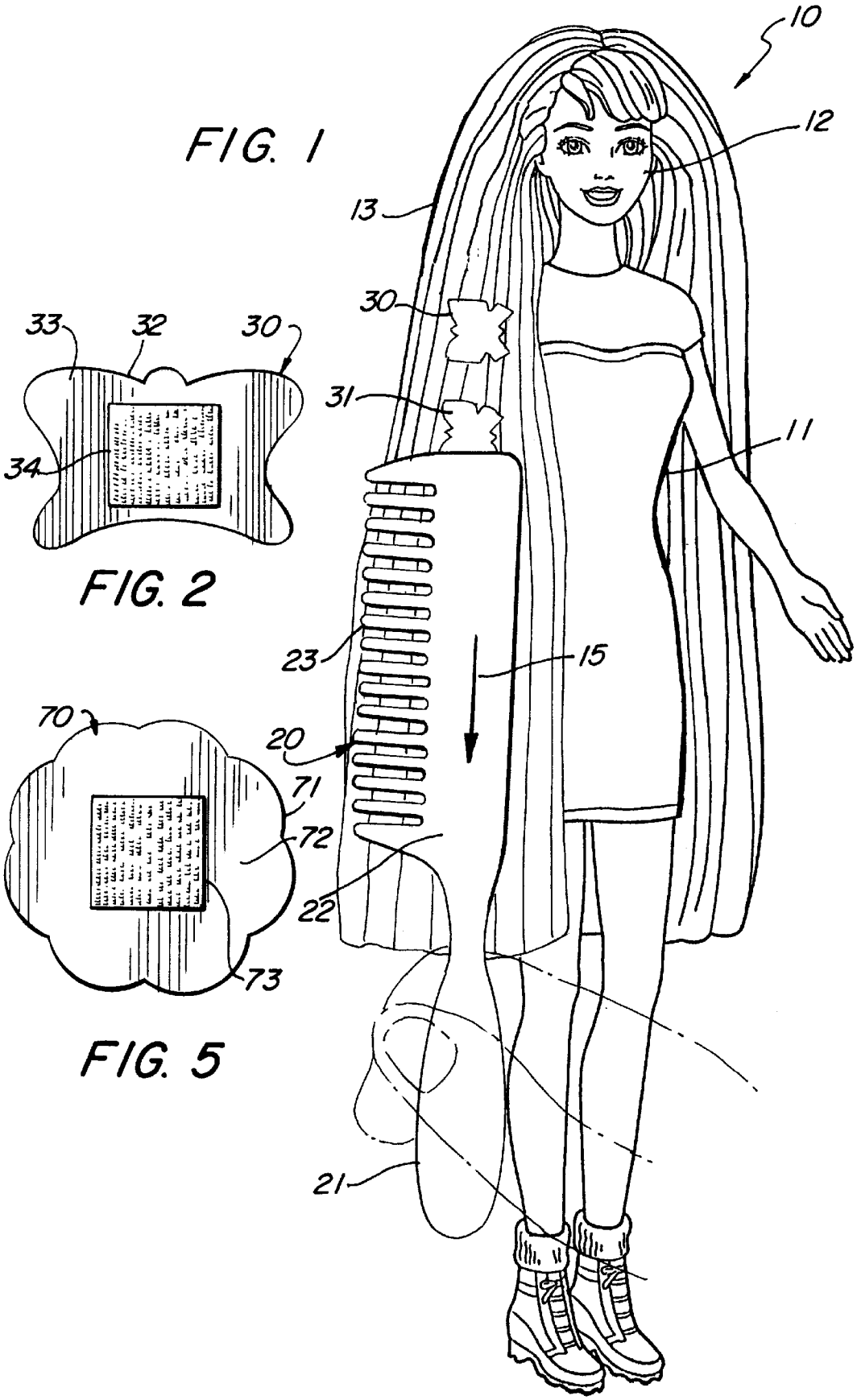
FIG. 1 sets forth a front perspective view of the present invention doll comb having apparatus for attaching ornaments in a typical use with a fashion doll.
FIG. 2 sets forth a rear view of an illustrative hair ornament constructed in accordance with the present invention.
FIG. 5 sets forth a rear view of an alternative hair ornament constructed in accordance with the present invention.

FIG. 1 sets forth a front perspective view of a doll generally referenced by numeral 10 in combination with a comb constructed in accordance with the present invention and generally referenced by numeral 20. Doll 10 is fabricated in accordance with conventional fabrication techniques and is of the type of the dolls generally described as fashion dolls. It will be apparent to those skilled in the art however, that the present invention is equally explicable to other dolls without departing from the spirit and scope of the present invention.

Doll 10 includes a body 11 of conventional fabrication having a head 12. Head 12 in turn supports a quantity of hair 13. Hair 13 is rooted to head 12 by conventional means (not shown) and extends downwardly along body 11. The length of hair selected for doll 10 is of an exaggerated length allowing full utilization of comb 20.

Comb 20 is preferably formed of a molded plastic material or the like and includes a handle 21 shaped for gripping by a child user and a comb head 22. Head 22 defines a plurality of spaced-apart comb teeth 23.

In accordance with the present invention and as is described below in greater detail, head 22 of comb 20 supports a plurality of hair ornaments such as hair ornaments 30 and 31 shown in FIG. 1. In further accordance with the apparatus set forth below in greater detail, the stroking of head 22 upon hair 13 in the direction indicated by arrow 15 transfers a plurality of hair ornaments such as hair ornaments 30 and 31 to hair 13. As is better seen in FIG. 2, hair ornament 30 includes a pad of hook-type fabric attachment material which in accordance with the present invention grips hair 13 as comb 20 is moved downwardly.

Thus, the child user is able to stroke comb 20 upon hair 13 and transfer one or more of the hair ornaments stored thereon to hair 13 and thereby ornament hair 13. Once attached, hair ornaments such as ornaments 30 and 31 are removable from hair 13 by simply grasping the hair ornaments and drawing them from hair 13 with sufficient force to overcome the temporary attachment of the hook pad material on the underside thereof. It will be apparent to those skilled in the art, that while illustrative hair ornaments 30 and 31 set forth in FIG. 1 generally resemble a butterfly in shape, other shapes may be used for hair ornaments in combination with comb 20 having similar attachment pads. By way of illustration, FIG. 5 shows a differently shaped hair ornament to illustrate this possible variation. It will be understood that still further differently shaped ornaments having hook-like attachment pads may be utilized without departing from the spirit and scope of the present invention.

FIG. 2 sets forth a rear view of an illustrative hair ornament generally referenced by numeral 30. Hair ornament 30 includes a generally planar body 32 preferably formed of a light-weight molded plastic material or the like. Body 32 defines a rear surface 33 supporting a pad of hook-type fabric attachment material 34. Pad 34 is secured to surface 33 using conventional adhesive attachment or the like.

Figure 3:
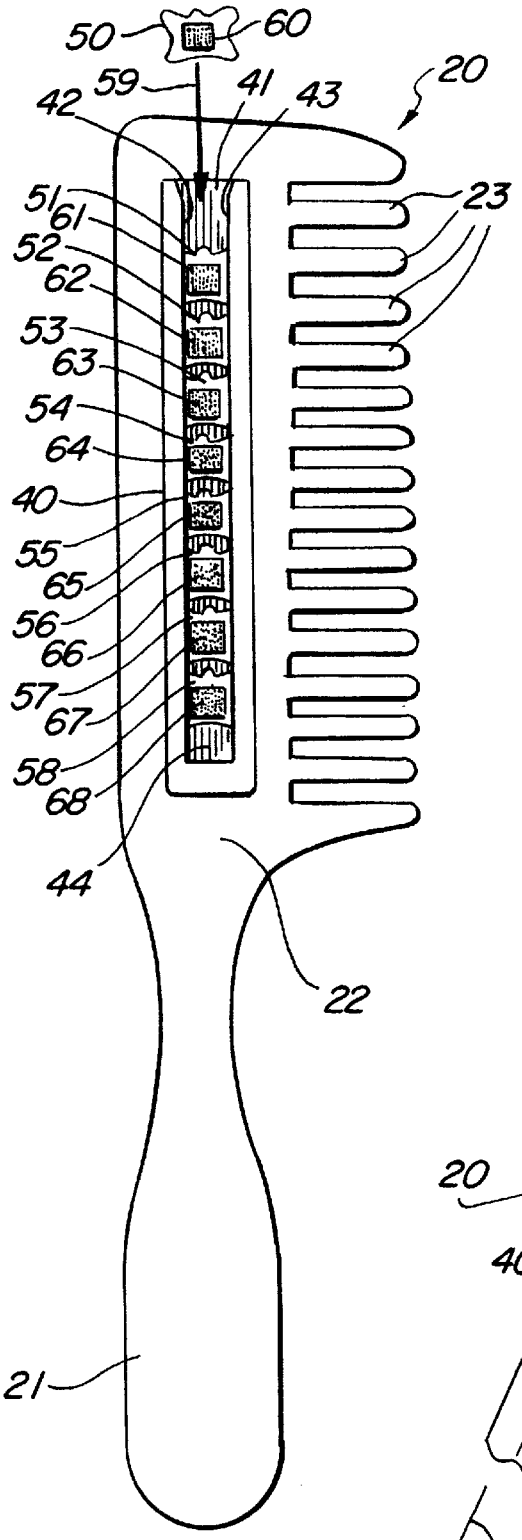
FIG. 3 sets forth a rear view of the doll comb shown in FIG. 1.

FIG. 3 sets forth a rear view of comb 20 which as described above is preferably formed of a molded plastic material or the like. As is also described above, comb 20 defines a handle 21 and a comb head 22. Comb head 22 in turn supports a plurality of generally parallel spaced-apart comb teeth 23.

In accordance with the present invention, comb head 22 further supports an elongated ornament magazine 40. Magazine 40 is preferably formed of a molded plastic material or the like, and is secured to head 22 using conventional attachment such as adhesives or alternatively other attachments such as chemical or sonic welding as desired. The important aspect is that magazine 40 is secured firmly to comb head 22. Comb head 22 defines an elongated channel 41 having inwardly extending lips 42 and 43 on each side thereof. As is better seen in FIG. 4, lips 42 and 43 are spaced above the rear surface of magazine 40 as sufficient distance to allow a hair ornament to slide into channel 41 and be captivated in a slidable attachment within magazine 40. Thus, lips 42 and 43 extend inwardly a short distance leaving a gap 44 therebetween.

A plurality of hair ornaments 51 through 58 are shown received within and captivated within magazine 40. In further accordance of an important aspect of the present invention, gap 44 is sufficient to provide clearance for a plurality of hook-type fabric attachment pads 61 through 68 supported upon the rear surfaces of hair ornaments 51 through 58 respectively in a similar fashion to hair ornament 30 shown in FIG. 2. With temporary reference to FIG. 4, it will be noted that the hook-type fabric attachment pads of the hair ornaments supported within channel 41 extend beyond lips 42 and 43. This facilitates this engagement with the doll's hair as magazine 40 is stroked upon doll hair in the manner shown in FIG. 4.

Returning to FIG. 3, a hair ornament 50 having a hook pad 60 is shown being loaded into magazine 40. In this assembly, the user simply aligns ornament 50 with channel 41 of magazine 40 such that hook pad 60 of ornament 40 is aligned with gap 44 of magazine 40. Thereafter, the user simply moves ornament 50 into channel 41 such that the outer edges of ornament 50 slide beneath lips 42 and 43 and hook pad 60 is exposed through gap 44.

Thus, the user is able to sequentially load a plurality of hair ornaments into channel 41 of magazine 40 and thereafter stroke head 22 and magazine 40 against the dolls hair to cause hook pads 61 through 68 to engage the underlying hair and thereby slide ornaments 51 through 58 outwardly from magazine 40 to remain secured to the dolls hair.

It will be apparent to those skilled in the art that the use of comb 20 is not limited solely to application of hair ornaments to a dolls hair. On the contrary, the use of comb 20 and hair ornaments 50 through 58 upon a quantity of human hair is equally feasible. In this manner, the child user is able to indulge in an additional exciting and amusing facet of hair play in which hair ornaments are transferred to the dolls hair and hair ornaments are also transferred to the child's hair. As a result, a more amusing sharing of hair ornamentation and hair play is accomplished.

Figure 4:
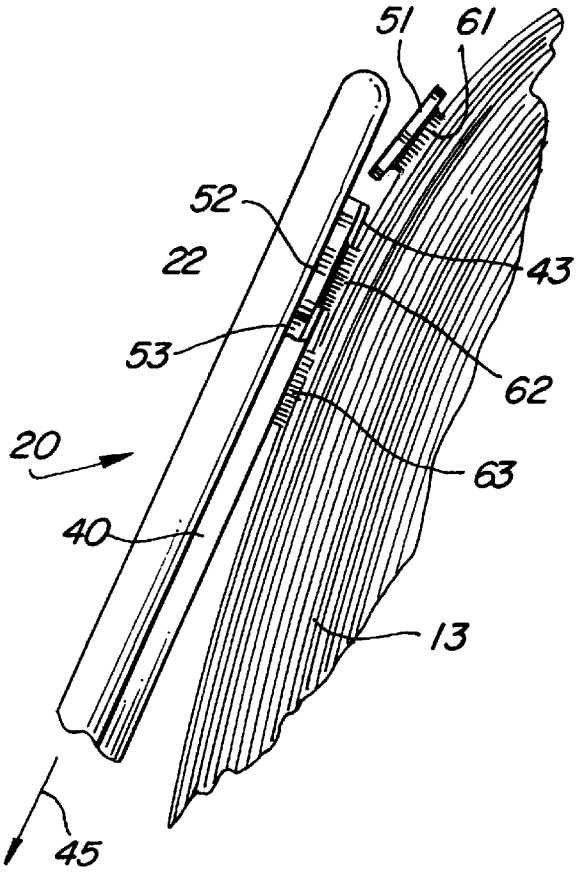
FIG. 4 sets forth a partial section view of a portion of the doll comb of FIG. 1 illustrating an ornament transfer.

FIG. 4 sets forth a partial section view of comb 20 applying a quantity of hair ornaments to a portion of doll hair 13. As described above, comb 20 includes a head 22 supporting an ornament magazine 40. As is also described above, magazine 40 defines a channel 41 within which a plurality of hair ornaments such as ornaments 52 and 53 are received. In further accordance with the present invention, ornaments 52 and 53 support extending hook-type fabric attachment pads 62 and 63. As mentioned above, magazine 40 is configured to confine a gap 44 (seen in FIG. 3) through which attachment pads 62 and 63 extend. As a result, as comb 40 is stroked downwardly in the direction indicated by arrow 45, the exposed attachment pads bind with hair 13 and creates sufficient grip to allow each of their respective hair ornaments to be drawn from channel 41 of magazine 40. For purposes of illustration, hair ornament 51 having attachment pad 61 is shown engaged upon hair 13 having been withdrawn from channel 1 by the movement of comb 20 in the direction indicated by arrow 45.

Thus, as the child user repeatedly strokes comb 20 upon either doll hair 13 or the child user's hair (not shown) one or more of the hair ornaments stored within magazine 40 is transferred to the hair.

As mentioned above, hair ornaments secured to hair 13 may be withdrawn therefrom by simply gripping the hair ornament and pulling it away from hair 13 overcoming the engagement of the hook attachment pads with the hair. Thereafter, magazine 40 may be reloaded as set forth above in connection with FIG. 3.

What has been shown is a novel doll comb having apparatus for attaching ornaments to doll hair or alternatively to a child user's hair in a simply stroking action. The inventive hair play accessory shown is capable of repeated use and may be provided with a variety of differently appearing hair ornaments. According FIG. 5 sets forth an alternative hair ornament generally referenced by numeral 70. Hair ornament 70 is shaped to generally resemble the outline of a flower. However, it will be apparent to those skilled in the art that ornament 70 may be shaped differently as the user desires to provide further variety of appearance. Accordingly, hair ornament 70 is fabricated in a very similar fashion to hair ornament 30 shown in FIG. 2 and includes a body 71 preferably formed of a light-weight material such as molded plastic or the like. Body 71 defines a rear surface 72 supporting a hook-type fabric attachment pad 73. As is also described above, pad 73 may be joined to surface 72 by conventional attachment means such as adhesive attachment or chemical or sonic bonding. By way of further variation, pad 73 may be integrally with body 71 as desired. The essential function of pad 73 is its ability to extend from magazine 40 (seen in FIG. 4) a sufficient distance to touch underlying hair and to engage such hair with sufficient grip and friction to be secured thereto in a temporary attachment.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A hairplay doll and doll comb comprising:

a doll having a quantity of doll hair;

a comb having a handle and a comb head defining a plurality of comb teeth;

an ornament magazine supported on said comb head defining an open ornament channel; and a plurality of hair ornaments each having an ornament body slidably receivable in said ornament channel and each having a hook attachment pad, said ornament magazine and said hair ornaments constructed to allow a portion of said hook attachment pads to extend beyond said magazine whereby said hook attachment pads are able to engage said doll hair when stroked against said doll hair to draw said hair ornaments from said ornament magazine.

2. The hairplay doll and doll comb set forth in claim 1 wherein said ornament magazine defines a pair of inwardly extending lips forming said open channel beneath said lips for receiving said hair ornaments.

3. The hairplay doll and doll comb set forth in claim 2 wherein said ornament magazine defines a gap between said lips.

4. The hairplay doll and doll comb set forth in claim 3 wherein said hair ornament bodies extend beneath said lips within said channel.

5. The hairplay doll and doll comb set forth in claim 4 wherein said attachment pads of said hair ornaments within said channel extend through said gap.

6. A doll and hairplay accessory comprising:

a doll having a quantity of hair;

a plurality of hair ornaments each having an ornament body and a fabric attachment pad constructed to engage hair; and an accessory defining an ornament channel for slidably receiving said plurality of hair ornaments, said ornament channel constructed to define a gap through which said attachment pads of said hair ornaments supported within said channel extend beyond said magazine to engage said doll hair when said accessory is stroked against said doll hair.

7. The doll and hairplay accessory set forth in claim 6 wherein said ornament magazine defines a pair of inwardly extending lips forming said open channel beneath said lips for receiving said hair ornaments.

8. The doll and hairplay accessory set forth in claim 7 wherein said ornament defines a gap between said lips.

9. The doll and hairplay accessory set forth in claim 8 wherein said hair ornament bodies extend beneath said lips within said channel.

10. The doll and hairplay accessory set forth in claim 9 wherein said attachment of said hair ornaments within said channel extend through said gap.

* * * * *